United States Patent [19]

Dienemann

[11] 4,353,223

[45] Oct. 12, 1982

[54] REFRIGERATOR WITH A LARGE REFRIGERATION CHAMBER COOLED BY NATURAL CONVECTION

[75] Inventor: Wolfgang Dienemann, Giengen, Fed. Rep. of Germany

[73] Assignee: Bosch-Siemens Hausgeräte GmbH, Stuttgart, Fed. Rep. of Germany

[21] Appl. No.: 165,549

[22] Filed: Jul. 3, 1980

[30] Foreign Application Priority Data

Jul. 17, 1979 [DE] Fed. Rep. of Germany ..... 2928774

[51] Int. Cl.[3] ..... F25D 13/02

[52] U.S. Cl. ..... 62/442

[58] Field of Search ..... 62/441, 442, 440, 443–444, 62/445, 465, 515, 519

[56] References Cited

U.S. PATENT DOCUMENTS

| | | | |
|---|---|---|---|
| 1,742,624 | 1/1930 | Weber | 62/443 X |
| 2,085,346 | 6/1937 | Vretman | 62/442 X |
| 2,328,189 | 8/1943 | Brace et al. | 62/442 X |
| 2,377,051 | 5/1945 | Sutton | 62/442 X |
| 2,787,132 | 4/1957 | Scott | 62/465 X |
| 3,267,692 | 8/1966 | Pfeiffer et al. | 62/515 |
| 3,313,123 | 4/1967 | Ware | 62/515 X |
| 3,382,683 | 5/1968 | Wiljanen | 62/441 X |

*Primary Examiner*—Lloyd L. King

*Attorney, Agent, or Firm*—Herbert L. Lerner; Laurence A. Greenberg

[57] ABSTRACT

Refrigerator having a large volume refrigeration chamber cooled by natural convection, including a defrostable finned evaporator disposed in upright position in the chamber, the evaporator being subdivided into at least two sections connected together in series in a refrigerant flow path, a view shield serving as an air baffle disposed in front of the evaporator, and a substantially horizontally disposed partition occupying substantially the entire usable cross sectional area of the chamber, the partition having an edge extended between the sections of the evaporator.

8 Claims, 1 Drawing Figure

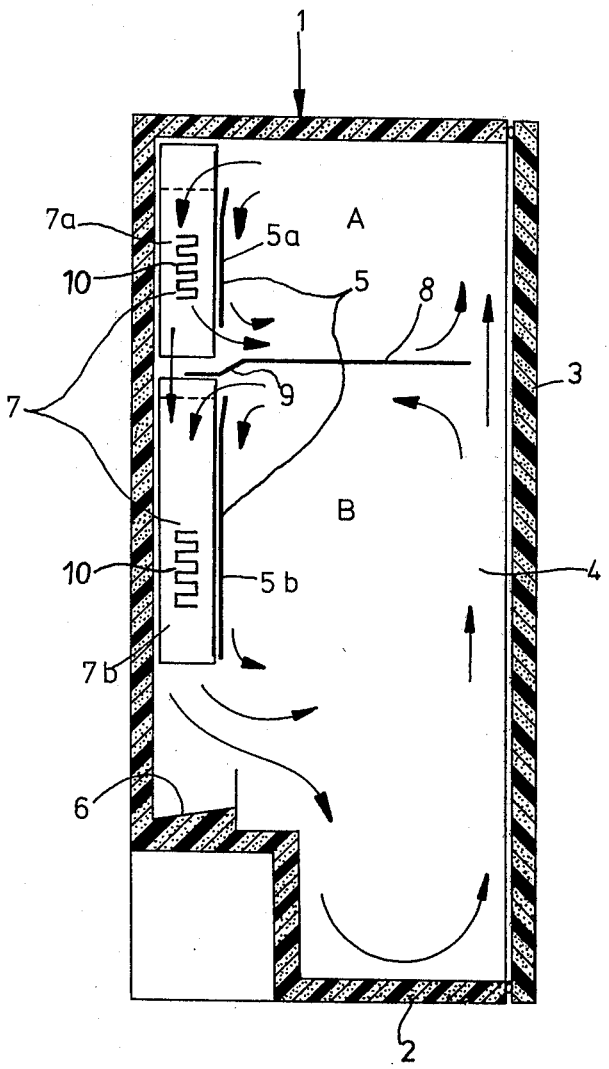
1
7a
5a
A
10
5
8
3
7
9
B
10
5 b
4
7 b
6
2

REFRIGERATOR WITH A LARGE REFRIGERATION CHAMBER COOLED BY NATURAL CONVECTION

The invention relates to a refrigerator with a large-volume refrigeration chamber, which is cooled by natural convection, and with a finned defrostable evaporator or the like, which is disposed in a standing position behind a view shield serving as an air baffle.

In refrigerators cooled by natural convection with evaporators disposed in the standing position, a greatly different temperature distribution sometimes occurs due to the convection flow, starting in the refrigerator from the evaporator, and the air circulation produced thereby. Thus, for instance, the temperature just underneath the evaporator is the lowest while it is highest in the upper zones of the refrigerator chamber. In addition, there are zones which are not at all or only barely touched by the air circulation and in which different temperatures will prevail. The temperature difference between the lower and the upper section of the refrigeration chamber likewise increases with increasing size of the refrigeration chamber. In refrigerators with a very large volume, this can go so far as to no longer ensure the maintenance of the conditions for proper storage of material to be refrigerated in the upper section of the refrigerator and that the material to be refrigerated which is stored at the bottom becomes colder than would be necessary for proper storage over a long period of time.

In known refrigerators of this type, it is therefore necessary to take care of uniform air circulation, and therefore to provide an equalized temperature equilazation in the refrigeration chamber, by using the installation of blowers and the forced ventilation produced thereby. Such blowers and the connections and switching elements required for their operation, however, make the manufacture of the refrigerator more expensive and in addition increase its power consumption, since the dissipation heat stemming from the drive of the blowers has a negative effect on the efficiency of the refrigeration machine. In addition, if such blowers are used, additional baffles must be installed. This, however, also reduces the available usable space in the refrigerator due to the space required for these baffles and the installation of the blowers.

It is accordingly an object of the present invention to provide a refrigerator with a large refrigeration chamber cooled by natural convection which overcomes the hereinafore mentioned disadvantages of the heretofore-known devices of this general type, and in a simple manner to eliminate the difficulties and disadvantages which occur in large refrigerators which are cooled only by natural convection, due to the uneven temperature distribution in a refrigeration chamber.

With the foregoing and other objects in view there is provided, in accordance with the invention, a refrigerator having a large volume refrigeration chamber cooled by natural convection, comprising a defrostable finned evaporator disposed in upright position in the chamber, the evaporator being subdivided into at least two sections connected together in series in a refrigerant flow path, a view shield serving as an air baffle disposed in front of the evaporator, and a substantially horizontally disposed partition occupying substantially the entire usable cross sectional area of the chamber, the partition having an edge facing the evaporator extended between the sections of the evaporator.

By means of the evaporator disposed in the refrigeration chamber in accordance with the invention, and the horizontal partition, it is possible by simple means, in a reliable manner, and with optimum space utilization, to adjust the flow conditions in the interior of the refrigerator chamber so that an almost uniform temperature prevails in the refrigeration chamber, and therefore allowing the upper section to be used as a quick-freezing compartment.

In accordance with another feature of the invention, there are provided fins disposed in the evaporator, the sections of the evaporator being formed by a break or interruption formed in the fins.

By means of the evaporator sections which are formed merely by interrupting the fins, a particularly simple and economically manufactured evaporator is obtained, which can be accommodated simply and in a space-saving manner in the refrigeration chamber of a refrigerator due to its compact construction.

In accordance with a further feature of the invention, the fins are spaced apart by a larger distance in upper regions than in other or remaining regions of the sections of the evaporator.

Because of the larger spacing of the fins in the upper regions, the frost which forms preferably on the inflow side of the evaporator cannot decrease the air flow cross section of the evaporator as fast, so that the evaporator needs to be defrosted less frequently to restore its proper function.

In accordance with an added feature of the invention, the edge of the partition is slightly inclined downward toward the evaporator forming an offset portion or angled-off crank.

In accordance with an additional feature of the invention, the evaporator sections are in the form of an upper and a lower section having air inflow regions with given cross-sectional areas at upper ends thereof, the edge of the partition being extended across substantially one half of the cross-sectional area of the inflow region of the lower evaporator section.

In accordance with yet another feature of the invention, the view shield has an upper portion angled-off away from the evaporator.

In accordance with yet a further feature of the invention, there is provided an automatic defrosting device for the evaporator.

In accordance with a concomitant feature of the invention, the view shield is subdivided into two sections, each section being disposed in front of one of the evaporator sections, each of the view shield sections having an upper portion angled-off away from the evaporator sections.

Other features which are considered as characteristic for the invention are set forth in the appended claims.

Although the invention is illustrated and described herein as embodied in a refrigerator with a large refrigeration chamber cooled by natural convection, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the single FIGURE of the drawing which is a diagrammatic cross-sectional view of a large-volume refrigerator, the refrigeration chamber of which is equipped with an evaporator subdivided into two sections, and is divided into two communicating chambers by means of a horizontal partition.

Referring now particularly to the single FIGURE of the drawing, there is seen a large-volume refrigerator 1, cooled by natural convection, that is equipped in the usual manner with a heat-insulating cabinet 2, which has a refrigeration chamber 4, which can be closed off by a likewise heat-insulated door 3. In the interior of the refrigeration chamber 4, in front of the back wall of the cabinet 2 and behind a view shield 5 serving as an air baffle, there is disposed an upright finned evaporator 7 which can be defrosted through a drip channel 6.

In the embodiment example shown, the evaporator 7 is subdivided horizontally into two sections *7a* and *7b*, which are connected in series in the flow path of the refrigerant, so that a horizontal space is formed between the two evaporator sections *7a* and *7b*. At the top of this interspace, a partition 8 is likewise horizontally disposed in the refrigerant chamber 4. This partition occupies almost the full usable cross section of the refrigerant chamber and projects into the space between the two evaporator sections *7a* and *7b* with its edge facing the evaporator 7. Its front edge extends toward the door 3 only far enough to ensure that between the two a sufficient flow cross section for the air remains open.

The partition 8 descends slightly toward the evaporator 7 and its edge zone facing the evaporator 7 is provided with an offset or crank 9 which is angled off downward. With this edge zone, the partition 8 extends over approximately the front half of the upper air inflow cross section of the lower evaporator section *7b*.

In the upper region of the evaporator sections indicated in the embodiment example shown in the drawings of both evaporator sections *7a* and *7b* by dotted lines, the fins of the evaporator have a larger spacing than in the rest of the region. This can be accomplished, for instance, by shortening the top of every second fin to the height of the dotted line.

The view shield 5 which is mounted in front of the evaporator 7 and serves as an air baffle, is likewise subdivided by a horizontal interruption into two sections 5*a* and 5*b*. Each section is provided at its upper edge with a slightly angled off portion, leading away from the respective evaporator section, thus forming a funnel-shaped inlet toward the respective evaporator section.

The slight bending-off of the view shields 5*a* and 5*b* which serve as air baffles, first of all serves for improving the flow conditions in the refrigeration chamber. However, the bending-off also has the purpose of catching defrosting water which drips from the fans of the evaporator when it is defrosted, or from the rear section of the partition 8, and possibly dropping frost and ice particles. It then ensures that these are conducted safely into the drip channel 6.

By means of the horizontal partition 8, the refrigeration chamber 4 of the refrigerator 1 is subdivided into two chambers designated with reference characters A and B. These chambers are disposed on top of each other but communicate with each other and with the respective evaporator sections *7a* and *7b* associated therewith. By means of this construction, an air flow is produced in the refrigeration chamber 4 which is excited by convection and which takes a path approximately according to the arrows shown in the FIGURE.

It will be seen that three air streams rotating in the same direction are produced. Of these, one is associated with the upper section A of the refrigeration chamber, the second one is associated with the lower section B of the refrigeration chamber, while the third one flows substantially in the outer area of the refrigeration chamber along the rear wall, the bottom, the door and the ceiling, and is superimposed on the other two air streams. Thus, intensive mixing of the air streams and therefore far-reaching equalization of the temperatures in the refrigeration chamber 4 is achieved solely by convection due to the depicted and described construction of the evaporator 7 and the partition 8. In this way, a sufficiently low temperature in the upper section A of the refrigeration chamber 4 is particularly obtained, and the upper section A can therefore also be used as a quick-freezing compartment. The refrigerator constructed in this manner is suitable particularly for operation with a heretofore-known automatic defrosting device 10.

Instead of the evaporator 7, which is subdivided into two sections *7a* and *7b* by a horizontal interruption of its vertical fins, provision may also be made for the fins to be continuously disposed and merely provided with a horizontal slot starting from the front of the evaporator, into which the edge zone of the partition 8 associated with the evaporator then extends.

There are claimed:

1. Refrigerator having a large volume refrigeration chamber cooled by natural convection, comprising a defrostable finned evaporator disposed in upright position in the chamber, said evaporator being subdivided into at least two sections connected together in series in a refrigerant flow path, a view shield serving as an air baffle disposed in front of each section of said evaporator, and a substantially horizontally disposed partition occupying substantially the entire usable cross sectional area of the chamber thus subdividing said chamber into two chambers, said partition having an edge extended between said sections of said evaporator so as to provide proper air flow between the divided chambers.

2. Refrigerator according to claim 1, including fins disposed in said evaporator, said sections of said evaporator being divided by a break between said fins.

3. Refrigerator according to claim 2, wherein said fins are spaced apart by a larger distance in upper regions than in other regions of said sections of said evaporator.

4. Refrigerator according to claim 1, wherein said edge of said partition is slightly inclined downward toward said evaporator forming an offset portion.

5. Refrigerator according to claim 1, wherein said evaporator sections are in the form of an upper and a lower section having air inflow regions with given cross-sectional areas at upper ends thereof, said edge of said partition being extended across substantially one half of said cross-sectional area of said inflow region of said lower evaporator section.

6. Refrigerator according to claim 1, wherein said view shield has an upper portion angled-off away from said evaporator.

7. Refrigerator according to claim 1, including an automatic defrosting device for said evaporator.

8. Refrigerator according to claim 1, wherein said view shield is subdivided into two sections, each section being disposed in front of one of said evaporator sections, each of said view shield sections having an upper portion angled-off away from said evaporator sections.

* * * * *